US010950954B2

(12) United States Patent
Hans et al.

(10) Patent No.: US 10,950,954 B2
(45) Date of Patent: Mar. 16, 2021

(54) TERMINAL ASSEMBLY AND METHOD

(71) Applicant: Lear Corporation, Southfield, MI (US)

(72) Inventors: Michael Hans, Novi, MI (US); Edgar Michael Racho, Lapu-lapu (PH); Thomas D. Belanger, Jr., New Hudson, MI (US); William Presley, Macomb, MI (US); David Menzies, Linden, MI (US); Lewis Galligan, Novi, MI (US)

(73) Assignee: Lear Corporation, Southfield, MI (US)

( * ) Notice: Subject to any disclaimer, the term of this patent is extended or adjusted under 35 U.S.C. 154(b) by 0 days.

(21) Appl. No.: 16/399,435

(22) Filed: Apr. 30, 2019

(65) Prior Publication Data

US 2020/0350702 A1 Nov. 5, 2020

(51) Int. Cl.

| | |
|---|---|
| ***H01R 4/10*** | (2006.01) |
| ***H01R 4/18*** | (2006.01) |
| ***H01R 43/048*** | (2006.01) |
| ***H01R 4/58*** | (2006.01) |

(52) U.S. Cl.

CPC ..... *H01R 4/185* (2013.01); *H01R 4/58* (2013.01); *H01R 43/048* (2013.01)

(58) Field of Classification Search

CPC ..... H01R 4/20; H01R 13/112; H01R 4/185; H01R 4/2466; H01R 13/04; H01R 23/025

USPC ..... 439/880, 857, 877, 397, 884, 418

See application file for complete search history.

(56) References Cited

U.S. PATENT DOCUMENTS

| | | | | |
|---|---|---|---|---|
| 4,829,146 | A | 5/1989 | Duve | |
| 6,310,292 | B1 | 10/2001 | Osborn | |
| 7,292,894 | B2 | 11/2007 | Belden | |
| 7,722,416 | B2 | 5/2010 | Gump et al. | |
| 8,177,591 | B2 | 5/2012 | Okamura et al. | |
| 8,485,853 | B2 | 7/2013 | Seifert et al. | |
| 8,519,267 | B2 | 8/2013 | Peters et al. | |
| 8,944,862 | B2 | 2/2015 | Sato | |
| 9,028,284 | B2 | 5/2015 | Lengert et al. | |
| 9,196,972 | B2 | 11/2015 | Todo et al. | |
| 9,318,815 | B2 * | 4/2016 | Mitose | H01R 4/185 |
| 2014/0106629 | A1 | 4/2014 | Matsushita | |
| 2014/0312097 | A1 * | 10/2014 | Miyazato | H01R 43/00 228/111 |

FOREIGN PATENT DOCUMENTS

| | | | |
|---|---|---|---|
| DE | 2723029 | A1 | 11/1978 |
| DE | 10223397 | A1 | 12/2003 |
| WO | 2011096527 | A1 | 8/2011 |

* cited by examiner

*Primary Examiner* — Phuong Chi Thi Nguyen

(74) *Attorney, Agent, or Firm* — Fishman Stewart PLLC

(57) ABSTRACT

A method of assembling a terminal assembly includes a terminal and a terminal insert. The terminal insert may be configured to be disposed at least partially in the terminal; the terminal and the terminal insert may be configured to receive at least a portion of a wire; and/or the terminal and the terminal insert may be configured to be crimped to the said wire. The terminal insert may include a first insert wing, a second insert wing a third insert wing, and/or a fourth insert wing. The terminal may include a first wing, a second wing, a third wing, and/or a fourth wing. The first wing of the terminal may be disposed proximate the first wing of the terminal insert and/or the second wing of the terminal may be disposed proximate the second wing of the terminal insert.

20 Claims, 13 Drawing Sheets

TERMINAL ASSEMBLY AND METHOD

TECHNICAL FIELD

The present disclosure generally relates to terminals and terminal assemblies, including electrical terminals that may be used in connection with electrical wires or cables.

BACKGROUND

This background description is set forth below for the purpose of providing context only. Therefore, any aspect of this background description, to the extent that it does not otherwise qualify as prior art, is neither expressly nor impliedly admitted as prior art against the instant disclosure.

Some terminal assemblies may be relatively complex to use and/or to assemble. For example, connecting a terminal with some electrical conductors may involve a complex process and may include many different steps and components. Some terminals may not be configured for use with conductors of different sizes, so different types of terminals may be used for various sizes of conductors.

There is a desire for solutions/options that minimize or eliminate one or more challenges or shortcomings of terminals, electrical terminals, and/or terminal assemblies. The foregoing discussion is intended only to illustrate examples of the present field and should not be taken as a disavowal of scope.

SUMMARY

The foregoing and other aspects, features, details, utilities, and/or advantages of embodiments of the present disclosure will be apparent from reading the following description, and from reviewing the accompanying drawings.

In embodiments, a terminal assembly may include a terminal and/or a terminal insert. The terminal insert may be configured to be disposed at least partially in the terminal; the terminal and the terminal insert may be configured to receive at least a portion of a wire; and/or the terminal and the terminal insert may be configured to be crimped to the said wire. The terminal insert may include a first insert wing, a second insert wing a third insert wing, and/or a fourth insert wing. The terminal may include a first wing, a second wing, a third wing, and/or a fourth wing. The first wing of the terminal may be disposed proximate the first wing of the terminal insert and/or the second wing of the terminal may be disposed proximate the second wing of the terminal insert. The third wing of the terminal may be disposed proximate the third wing of the terminal insert. The fourth wing of the terminal may be disposed proximate the fourth wing of the terminal insert.

With embodiments, the terminal insert may include a first channel that may be provided by the first wing and/or the second wing. The terminal insert may include a second channel that may be provided by the third wing and/or the fourth wing. The first channel may be wider than the second channel. Said wire may include a conductor portion and/or an insulator portion. The first channel may be configured to receive at least a portion of the conductor portion. The second channel may be configured to receive at least a portion of the insulator portion. The terminal insert may include a monolithic component that may be formed independently of the terminal. Th terminal insert may include a plurality of crossing metal segments.

In embodiments, a method of assembling a terminal assembly may include providing a terminal. The terminal may include a terminal body, a first wing, a second wing, a third wing, and/or a fourth wing. The method may include providing a terminal insert. The terminal insert may include a first insert wing and/or a second insert wing. The method may include providing a wire and/or inserting the terminal insert into the terminal. The method may include inserting the wire into the terminal insert and/or the terminal. The method may include crimping the terminal insert and/or the terminal to the wire. Crimping the terminal may include bending the first wing, the second wing, the third wing, and/or the fourth wing about the wire. Crimping the terminal insert and/or the terminal with the wire may include deforming the terminal insert to fill gaps between the terminal and/or a conductor of the wire. The method may include disposing the terminal insert in contact with the first wing, the second wing, and/or the terminal body. After crimping, at least a portion of the terminal insert may be disposed at a top surface of a conductor of the wire. The terminal insert may be configured to increase an effective diameter of the wire.

With embodiments, an electrical assembly may include a first terminal assembly and/or a second terminal assembly. The first terminal assembly may include a first terminal, a terminal insert, and/or a first wire. The second terminal assembly may include a second terminal and/or a second wire. The first terminal may be substantially the same as the second terminal, and/or the first wire may be smaller than the second wire. The first terminal may be crimped to the terminal insert and/or the first wire. The second terminal may be crimped to the second wire. The first terminal and/or the terminal insert may be in contact with the first wire. The terminal insert may be substantially U-shaped and/or may include a plurality of crossing metal segments. A first extraction force associated may be associate with the first terminal assembly and/or may be substantially the same as a second extraction force that may be associated with the second terminal assembly. A diameter of the first wire may be at least 40% smaller than a diameter of the second wire. The terminal insert may increase an effective diameter of the first wire such that the effective diameter of the first wire may be substantially equal to the diameter of the second wire.

DETAILED DESCRIPTION

Reference will now be made in detail to embodiments of the present disclosure, examples of which are described herein and illustrated in the accompanying drawings. While the present disclosure will be described in conjunction with embodiments and/or examples, it will be understood that they are not intended to limit the present disclosure to these embodiments and/or examples. On the contrary, the present disclosure is intended to cover alternatives, modifications, and equivalents.

Figure 1:
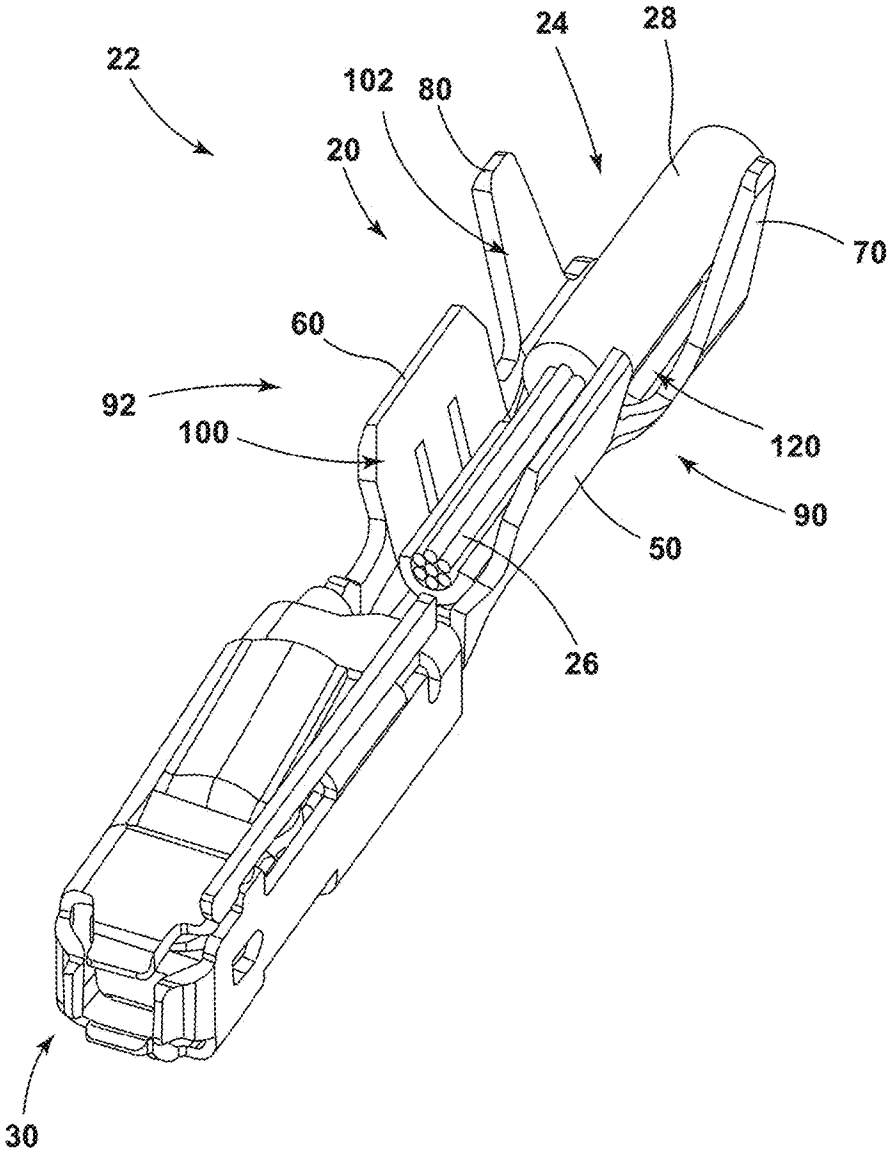
FIG. 1 is a perspective view generally illustrating an embodiment of a terminal assembly according to teachings of the present disclosure.
Figure 2:
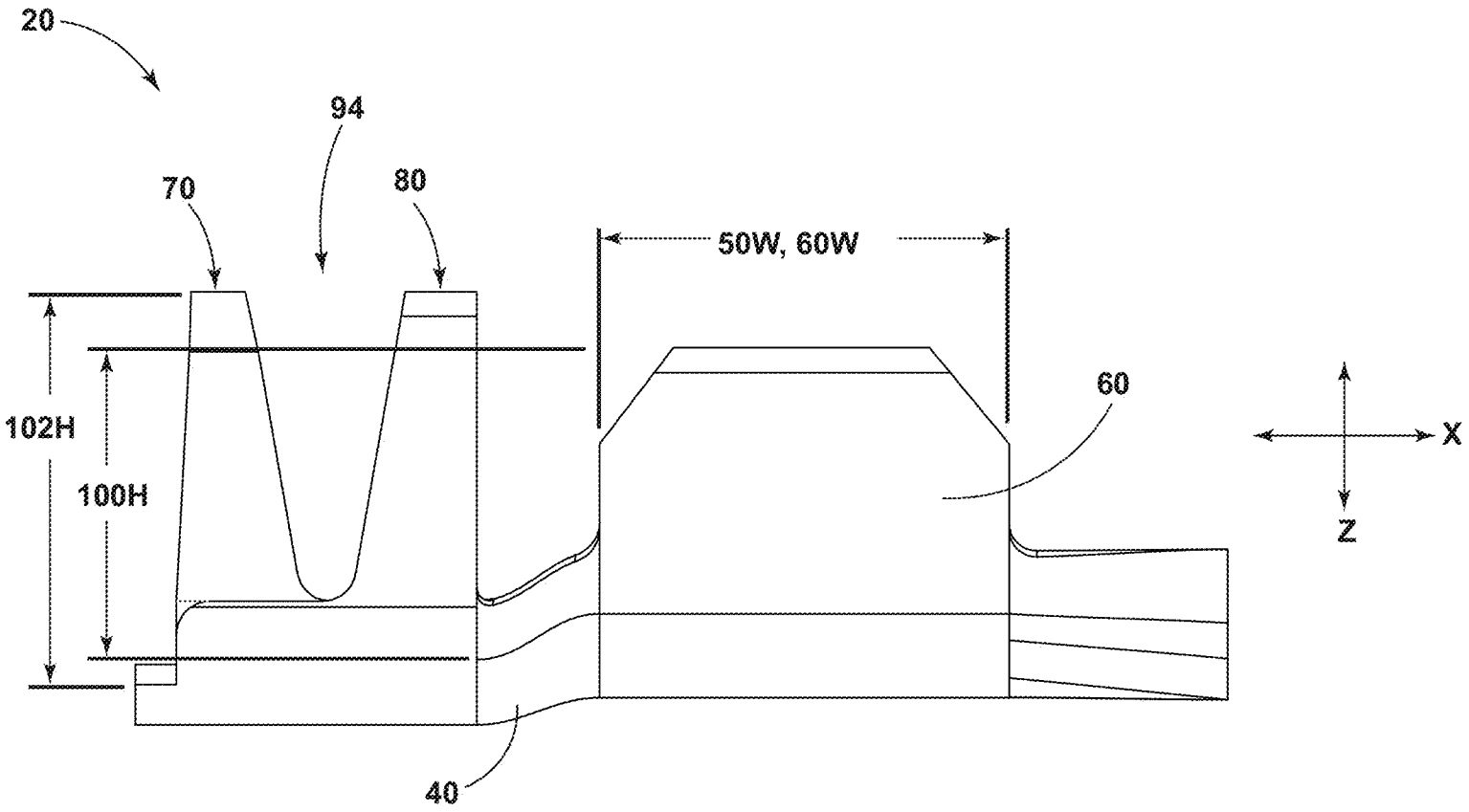
FIG. 2 is a side view generally illustrating an embodiment of a terminal according to teachings of the present disclosure.

In embodiments, such as generally illustrated in FIGS. 1 and 2, a terminal assembly 22 may include a terminal 20 and/or a terminal insert 120. The terminal 20 may include and/or be connected to a receiving portion 30. The receiving portion 30 may be configured to receive a male terminal or pin 32. The terminal assembly 22 may include a wire 24. The wire 24 may include a conductor 26 and/or an insulator 28. The insulator 28 may be connected to and/or at least partially surround the conductor 26. The insulator 28 may include an electrically insulating material. With embodiments, the terminal 20 and/or the terminal insert 120 may be configured to retain a wire 24. For example the terminal 20, the terminal insert 120, and/or the wire 24 may be configured to be crimped together, and/or the terminal 20 and/or the terminal insert 120 may be configured to be crimped to/with the wire 24. The terminal 20 may include a body portion 40, a first wing 50, a second wing 60, a third wing 70, and/or a fourth wing 80. The terminal 20 may include one or more of a variety of shapes, sizes, and/or configurations. For example and without limitation, the terminal 20 may be substantially U-shaped and/or V-shaped.

In embodiments, such as generally illustrated in FIGS. 1-4, a body portion 40, a first wing 50, and/or a second wing 60 may include respective inner surfaces and outer surfaces. The first terminal wings 50, 60 may include at least a portion that is substantially flat and/or planar. With embodiments, the terminal 20 may include a third wing 70 and/or a fourth wing 80. The first wing 50, the second wing 60, the third wing 70, and/or the fourth wing 80 may extend outward (e.g., vertically and/or laterally) from the body portion 40. The first wing 50, the second wing 60, the third wing 70, and/or the fourth wing 80 may or may not extend at substantially the same angle (e.g., oblique and/or right angles) from the body 40. The first wing 50 and the second wing 60 may extend at the same angle in opposite directions relative to the Z-direction. The third wing 70 and the fourth wing 80 may extend at the same angle in opposite directions relative to the Z-direction.

With embodiments, the first wing 50 and the third wing 70 may extend from a first side 90 of the body portion 40, and/or the second wing 60 and the fourth wing 80 may extend from a second side 92 of the body portion 40. In embodiments, the first wing 50 and the second wing 60 may be disposed opposite each other, and/or the third wing 70 and the fourth wing 80 may be disposed opposite each other. With embodiments, the first wing 50 and the second wing 60 may include lengths 50L, 60L (e.g., from a bottom of the wings to the top of the wings), which may or may not be the same. The third wing 70 and the fourth wing 80 may include lengths 70L, 80L, which may or may not be the same. The lengths 50L, 60L may be different than the lengths 70L, 80L (e.g., shorter or longer). In embodiments, the first wing 50 and the second wing 60 may include widths 50W, 60W (e.g., relative to the X-direction), which may or may not be the same (see, e.g., FIG. 2).

In embodiments, such as generally illustrated in FIGS. 1-4, the third wing 70 and/or the fourth wing 80 may be offset, such as in the X-direction (e.g., not disposed directly across from each other). For example and without limitation, the third wing 70 may be disposed farther from the first wing 50 and/or the second wing 60 than the fourth wing 80. With embodiments, there may be a gap 94 (e.g., in the X-direction) between the third wing 70 and the fourth wing 80 (see, e.g., FIG. 2).

With embodiments, such as generally illustrated in FIG. 1, the body portion 40, the first wing 50, and/or the second wing 60 may form a first channel 100. The body portion 40, the third wing 70, and/or the fourth wing 80 may form a second channel 102. With embodiments, the first channel 100 and/or the second channel 102 may be at least partially aligned (e.g., aligned in the X-direction and/or the Y-direction). The first wing 50 and the second wing 60 may be configured to retain a conductor 26 of a wire 24, such as via crimping. The third wing 70 and the fourth wing 80 may be configured to retain an insulator 28 of a wire 24, such as via crimping.

Figure 3:
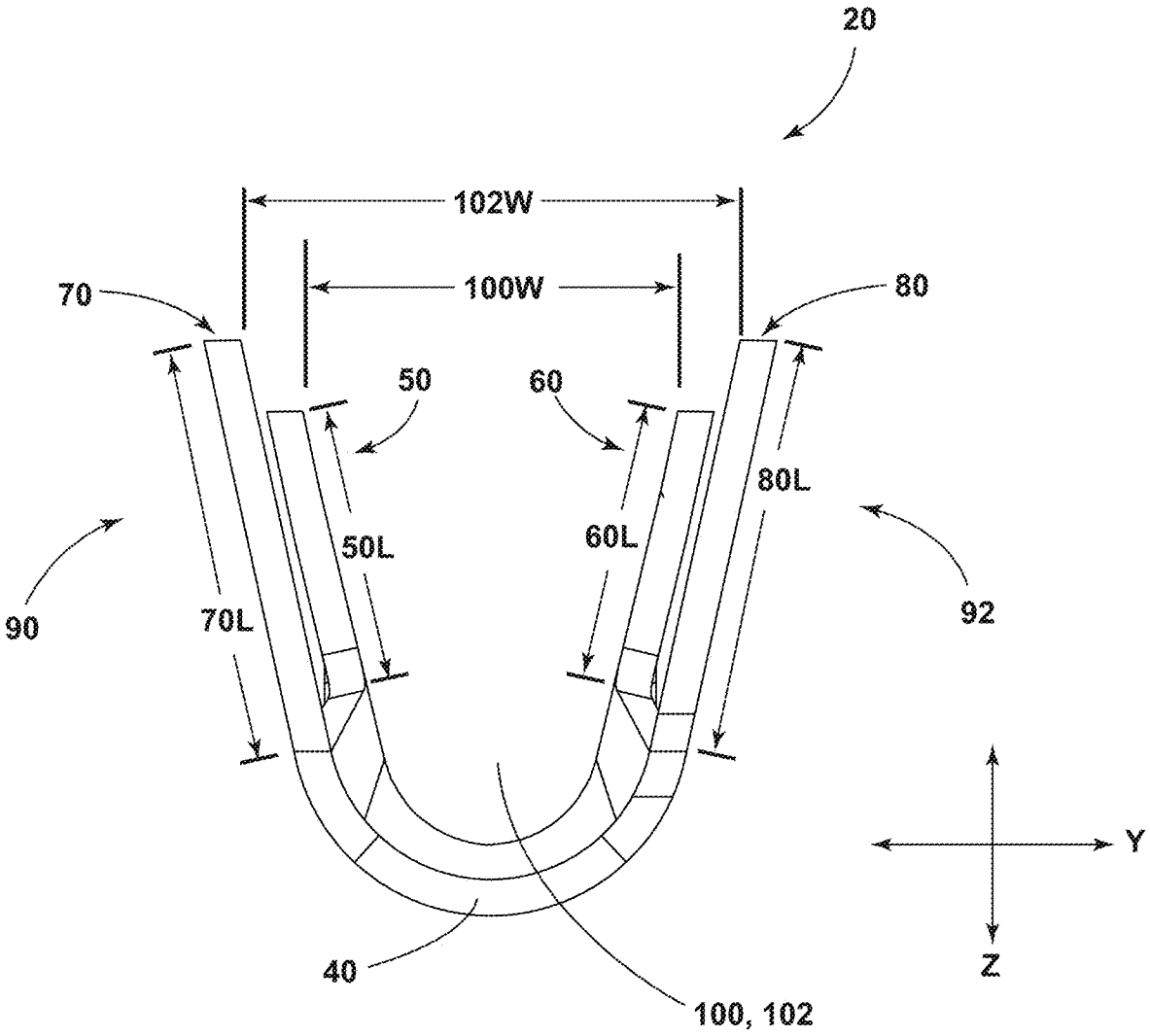
FIG. 3 is a side view generally illustrating an embodiment of a terminal according to teachings of the present disclosure.
Figure 4:
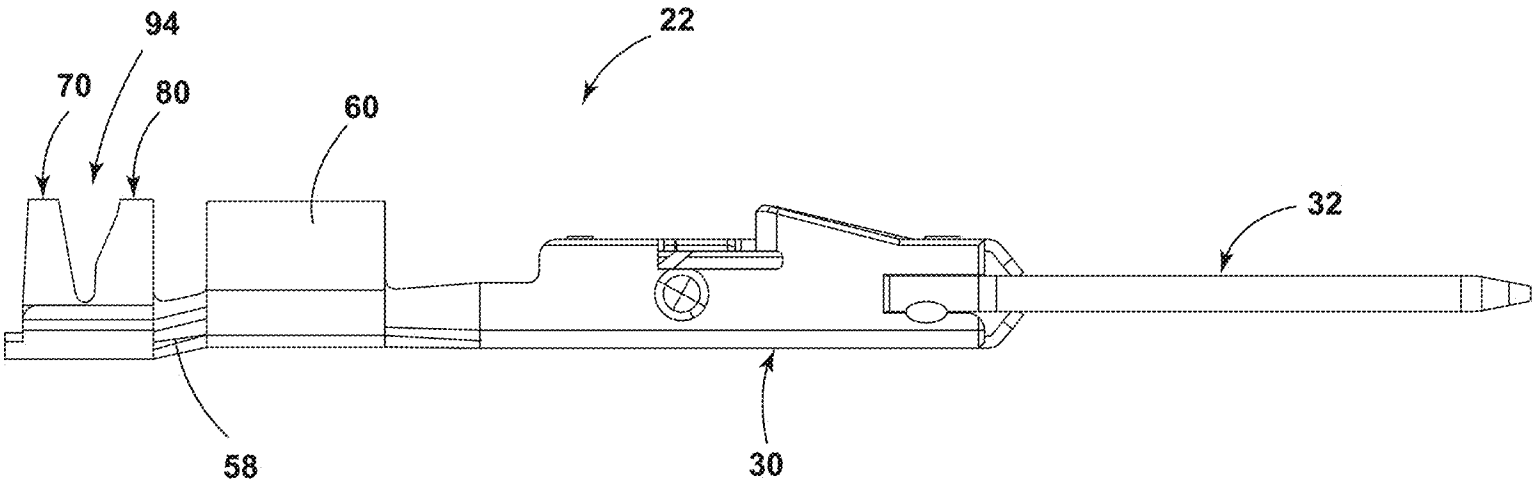
FIG. 4 is a side view generally illustrating an embodiment of a terminal assembly according to teachings of the present disclosure.

In embodiments, such as generally illustrated in FIG. 3, the first channel 100 may include a width 100W and the second channel 102 may include a width 102W (e.g., in a Y-direction). The first channel width 100W may be less than the second channel width 102W. With embodiments, the first channel 100 may include a first height 100H (e.g., in the Z-direction), and the second channel 102 may include a second height 102H (e.g., in the Z-direction). The second height 102H may be greater than the first height 100H when measured from the same vertical position of the terminal 20 (e.g., at or about end portions of the wings 50, 60, 70, 80).

With embodiments, such as generally illustrated in FIGS. 1, 5-9, 11A, and 11B, the terminal assembly 22 may include a terminal insert 120. The terminal insert 120 may be connected to and/or at least partially disposed within the terminal 20. The terminal insert 120 may include one or more of a variety of shapes, sizes, and/or configurations. For example and without limitation, the terminal insert 120 may extend substantially in the X-direction, and/or the terminal insert 120 may be substantially curved and/or planar. The terminal insert 120 may be configured to facilitate a physical connection and/or an electrical connection between the terminal 20 and the wire 24, such as via crimping. A terminal insert 120 may be formed independently from the terminal 20. A terminal 20 and/or terminal insert 120 may be formed as separate monolithic components (e.g., separate, single, unitary components).

Figure 10B:
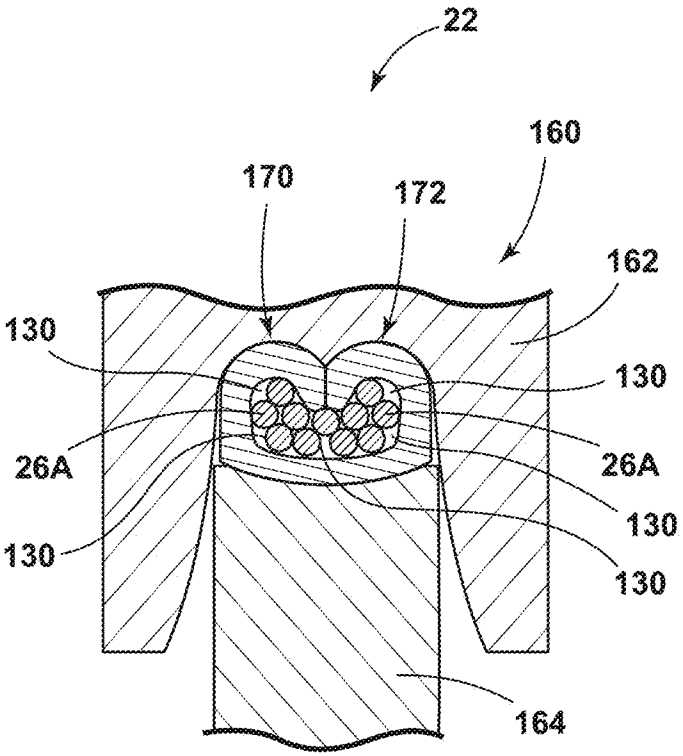
FIG. 10B is a cross-sectional view generally illustrating embodiments of a crimped terminal assembly without a terminal insert and a crimping die according to teachings of the present disclosure.
Figure 10A:
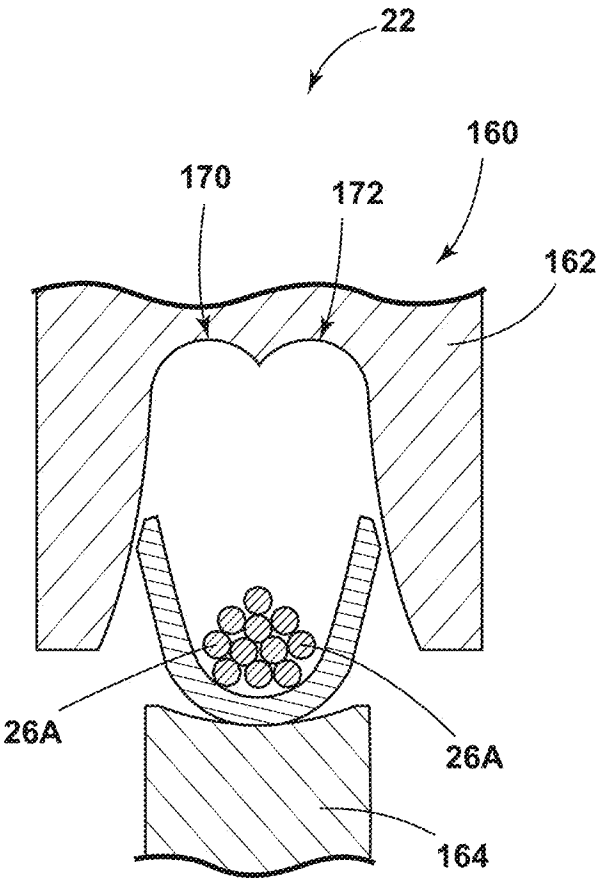
FIG. 10A is a cross-sectional view generally illustrating embodiments of an uncrimped terminal assembly without a terminal insert and a crimping die according to teachings of the present disclosure.

As generally illustrated in FIGS. 10A and 10B, crimping of a terminal 20 (without a terminal insert 120) with a relatively small wire, may, for example, result in gaps 130 being present between the terminal 20 and the conductors 26, which may limit the effectiveness of the electrical and/or physical connection between the conductors 26 and the terminal 20.

Figure 11B:
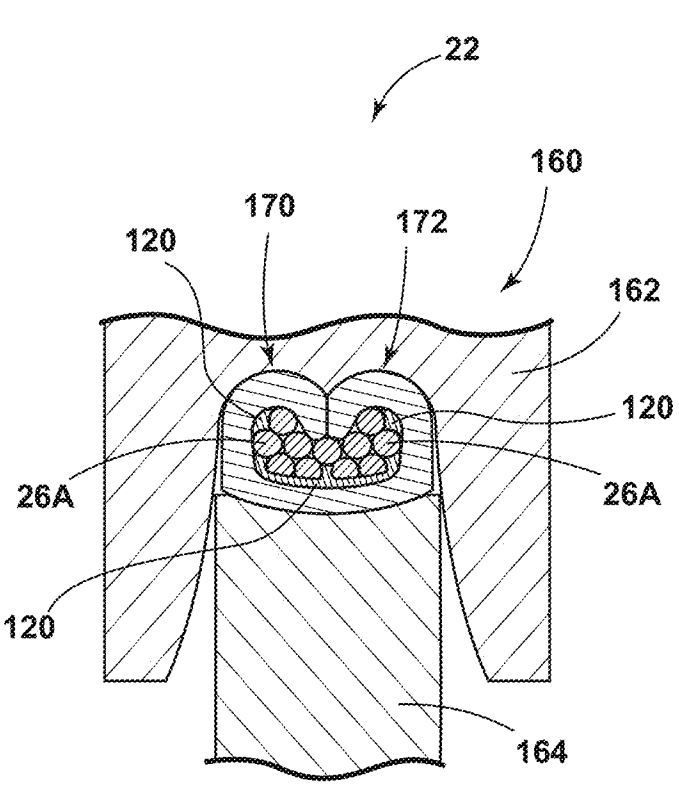
FIG. 11B is a cross-sectional view generally illustrating embodiments of a crimped terminal assembly with a terminal insert and a crimping die according to teachings of the present disclosure.
Figure 11A:
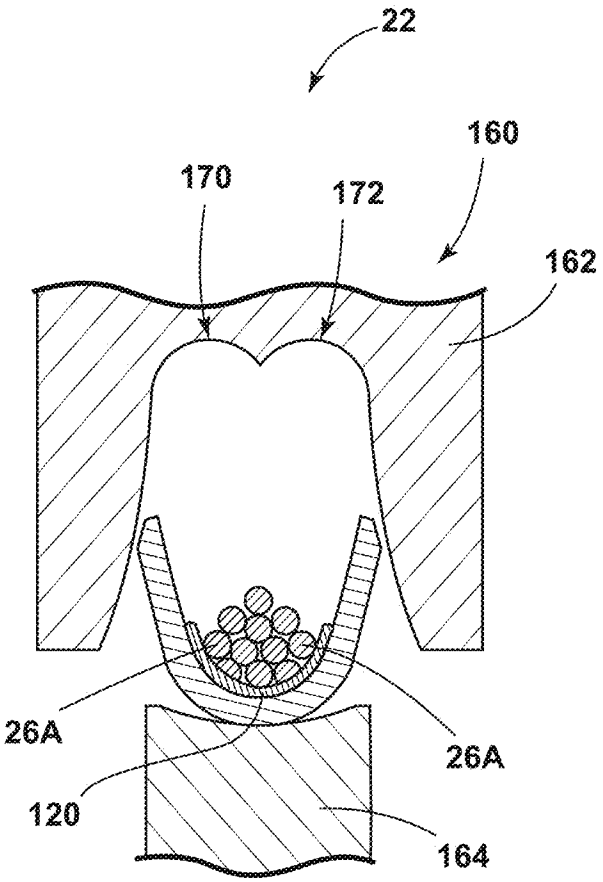
FIG. 11A is a cross-sectional view generally illustrating embodiments of an uncrimped terminal assembly with a terminal insert and a crimping die according to teachings of the present disclosure.

As generally illustrated in FIGS. 11A and 11B, providing a terminal insert 120 may improve the connection between the conductors 26 and the terminal 20, such as via reducing the amount of and/or the size of gaps 130, which may allow the terminal 20 to be used with a wider variety of wire sizes while maintaining a sufficient connection. For example and without limitation, the terminal insert 120 may add material volume to the terminal assembly 22 and/or effectively increase the size of the wire 24 (and/or decrease inner dimensions of the terminal 20), which may allow a relatively large terminal 20 to be crimped to large wires and small wires without the need to change the size of the terminal 20 (or to use different terminals for different wire sizes). The terminal insert 120 may, for example and without limitation, be configured for use with wires ranging from 0.08 $mm^2$ to 0.35 $mm^2$ (e.g., small wire sizes that do not include the terminal insert 120 may not result in a successful/sufficient crimp/connection).

Figure 14:
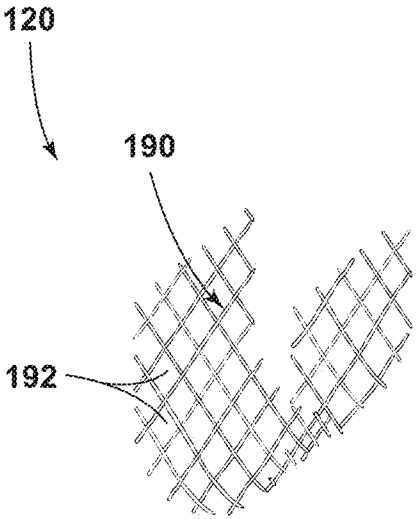
FIG. 14 is a perspective view generally illustrating an embodiment of a terminal insert according to teachings of the present disclosure.
Figure 13:
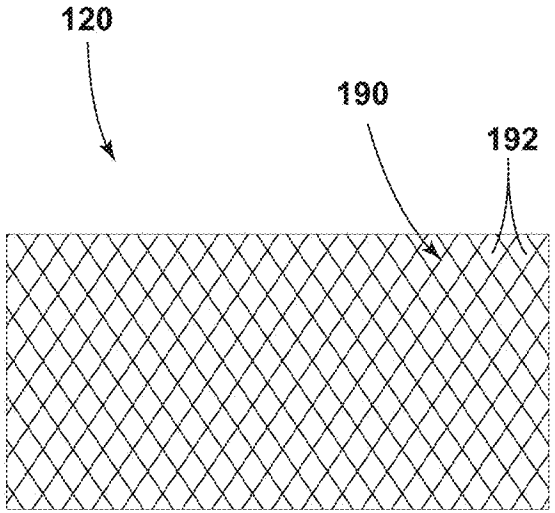
FIG. 13 is a top view generally illustrating an embodiment of a terminal insert according to teachings of the present disclosure.

In embodiments, the terminal insert 120 may include one or more of a variety of electrically conductive materials and/or may be formed as a discrete component. For example and without limitation, the terminal insert 120 may include a metal and/or metal alloy (e.g., tin, copper, aluminum, etc.). The terminal insert 120 may be plated and/or clad with a metal material. For example and without limitation, the terminal insert 120 may include a first metal material that may be compatible with the surface of the terminal 20, and/or the terminal insert 120 may include a second metal material that may be compatible with the conductor 26. The terminal insert 120 may include a solid configuration, and/or the terminal insert 120 may be constructed in a mesh/lattice configuration. For example and without limitation, the a mesh/lattice configuration may include a plurality of crossing metal segments 190 (see, e.g., FIGS. 13 and 14) that may be connected to form the terminal insert 120. The terminal insert 120 may be stamped from a sheet of metal and/or may include a plurality of apertures 192 that may be formed via the metal segments 190.

In embodiments, such as generally illustrated in FIGS. 5-9, the terminal insert 120 may include a first body portion 140 and/or a second body portion 142. The first body portion 140 may be disposed at least partially in the first channel 100. The second body portion 142 may be disposed at least partially in the second channel 102. The first body portion 140 may be configured to contact and/or electrically connect to the conductor 26, and/or the second body portion 142 may be configured to contact the insulator 28. The first body portion 140 and/or the second body portion 142 may be substantially U-shaped or V-shaped. The first body portion 140 may include a first wing 144 and/or a second wing 146. The first wing 144 and/or the second wing 146 may extend from the first body portion 140 of the terminal insert 120. The second body portion 142 may include a third wing 150 and/or a fourth wing 152. The third wing 150 and/or the fourth wing 152 may extend from the second body portion 142 of the terminal insert 120. The first wing 144, the second wing 146, the third wing 150, and/or the fourth wing 152 may extend outward (e.g., vertically and/or laterally) from the first body portion 140 and/or the second body portion 142. The first wing 144, the second wing 146, the third wing 150, and/or the fourth wing 152 may or may not extend at substantially the same angle (e.g., oblique and/or right angles) from the first body portion 140 and/or the second body portion 142. The first wing 144 and the second wing 146 may extend at the same angle in opposite directions relative to the Z-direction. The third wing 150 and/or the fourth wing 152 may extend at substantially the same angle in opposite directions relative to the Z-direction. The first wing 144 and the second wing 146 may be disposed opposite each other, and/or the third wing 150 and the fourth wing 152 may be disposed opposite each other.

Figure 6:
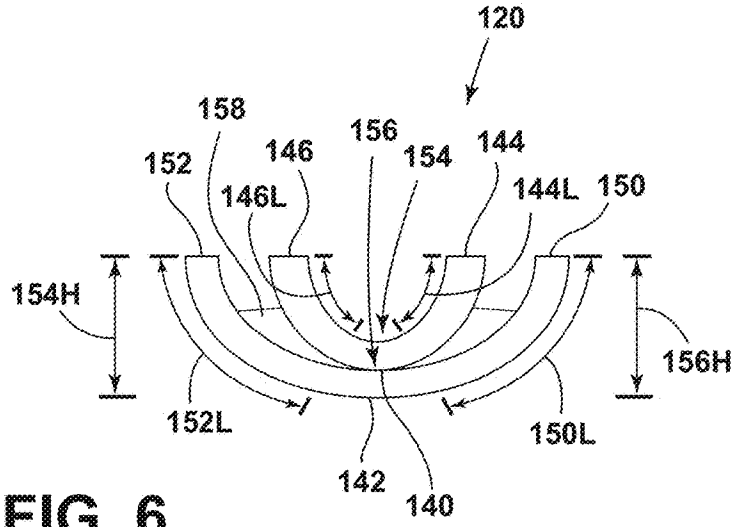
FIG. 6 is a side view generally illustrating an embodiment of a terminal insert according to teachings of the present disclosure.

With embodiments, such as generally illustrated in FIG. 6, the first wing 144 and the second wing 146 may include radial and/or curved lengths 144L, 146L (e.g., from a bottom of the wings to a top of the wings), which may or may not be the same. The third wing 150 and the fourth wing 152 may include radial and/or curved lengths 150L, 152L, which may or may not be the same. The lengths 150L, 152L, may be different or the same as the lengths 144L, 146L (e.g., shorter or longer). In embodiments, the first wing 144 and the second wing 146 may include widths 144W, 146W (e.g., relative to the X-direction), which may or may not be the same.

Figure 7:
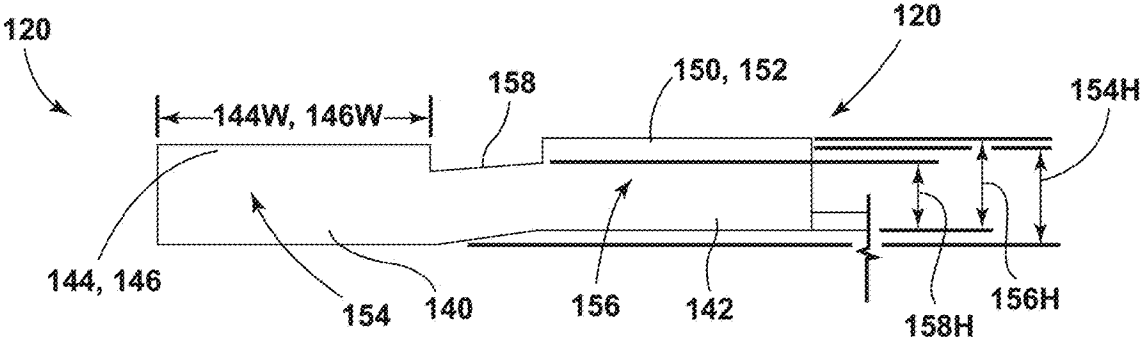
FIG. 7 is side a view generally illustrating an embodiment of a terminal insert according to teachings of the present disclosure.

In embodiments, such as generally illustrated in FIGS. 6 and 7, the first body portion 140, the first wing 144, and/or the second wing 146 may form a first channel 154. The second body portion 142, the third wing 150, and/or the fourth wing 152 may form a second channel 156. With embodiments, the first channel 154 and/or the second channel 156 may be aligned, such as in the X-direction and/or the Y-direction. The first channel 154 may include a width 154W and the second channel 156 may include a width 156W (e.g., in the Y-direction). The first channel width 154W may be less than the second channel width 156W. With embodiments, the first channel 154 may include a first height 154H (e.g., in the Z-direction), and/or the second channel 156 may include a second height 156H (e.g., in the Z-direction). The second height 156H may be different or the same as the first height 154H when measured from the same vertical position of the terminal insert 120 (e.g., at or about ends of the wings).

Figure 5:
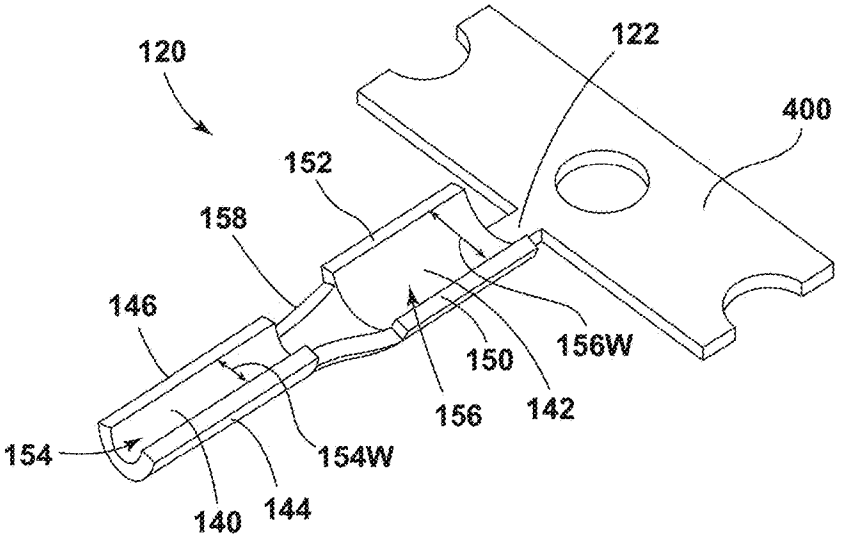
FIG. 5 is a perspective view generally illustrating an embodiment of a terminal insert according to teachings of the present disclosure.
Figure 9:
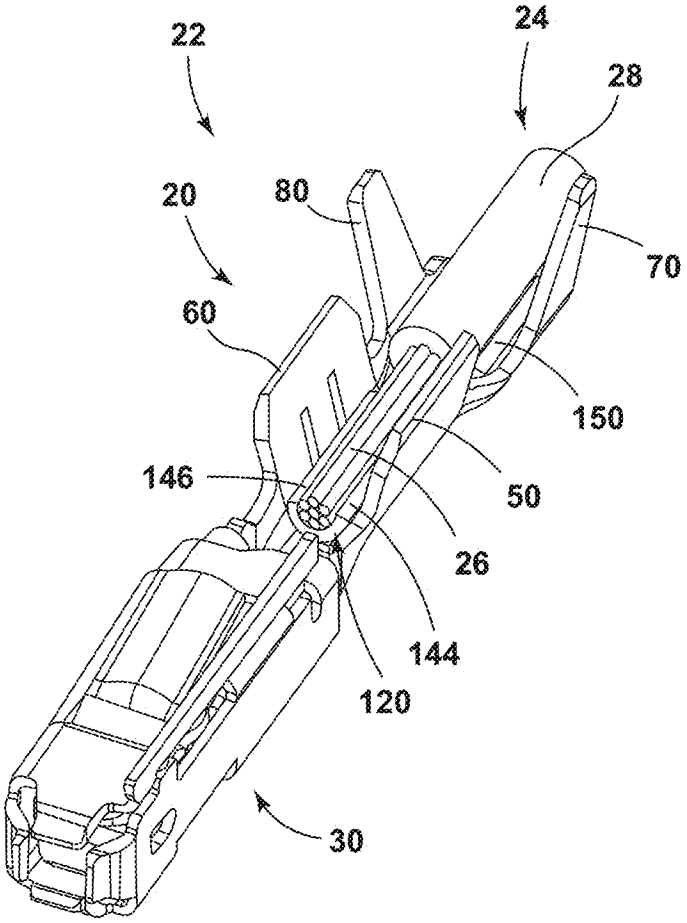
FIG. 9 is a perspective view generally illustrating an embodiment of a terminal assembly according to teachings of the present disclosure.
Figure 8:
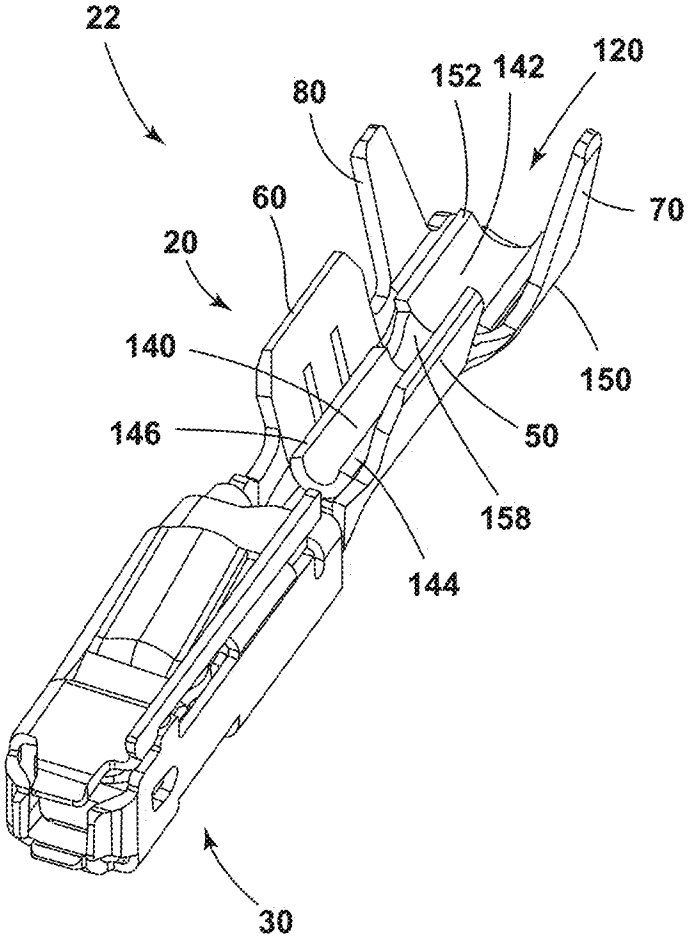
FIG. 8 is a perspective view generally illustrating an embodiment of a terminal assembly according to teachings of the present disclosure.

With embodiments, such as generally illustrated in FIGS. 5, 8, and 9, the first body portion 140 may be connected to the second body portion 142 via a connecting portion 158. The connecting portion 158 may be disposed between the first body portion 140 and the second body portion 142. The connecting portion 158 may be configured to receive at least a portion of the conductor 26 and/or the insulator 28 (e.g., at least a portion of the wire 24). The connecting portion 158 may not include wings and/or may include a height 158H that may be shorter than the first wing 144, the second wing 146, the third wing 150, and/or the fourth wing 152.

In embodiments, such as generally illustrated in FIGS. 8, 9, 11A, and 11B, a method of assembling a terminal assembly 22 may include providing a terminal 20, providing a terminal insert 120, and/or providing a wire 24. The method may include bending one or more of the wings 50, 60, 70, 80 of the terminal 20 and/or bending one or more of the wings 144, 146, 150, 152 of the terminal insert 120 via a die 160. Crimping the terminal 20 and/or the terminal insert 120 may include crimping the first wing 50 and the second wing 60 of the terminal 20 and/or the first wing 144 and the second wing 146 of the terminal insert 120 with the conductor 26 of the wire 24. Additionally or alternatively, crimping the terminal 20 and/or the terminal insert 120 may include crimping the third wing 70 and the fourth wing 80 of the terminal 20 and/or the third wing 150 and the fourth wing 152 of the terminal insert 120 with the insulator 28 of the wire 24. With embodiments, a die 160 may be configured to bend and/or crimp the terminal 20 and/or the terminal insert 120 onto the wire 24. The die 160 may include a top portion 162 and/or a bottom portion 164. The top portion 162 may be disposed substantially parallel to the bottom portion 164.

Figure 12:
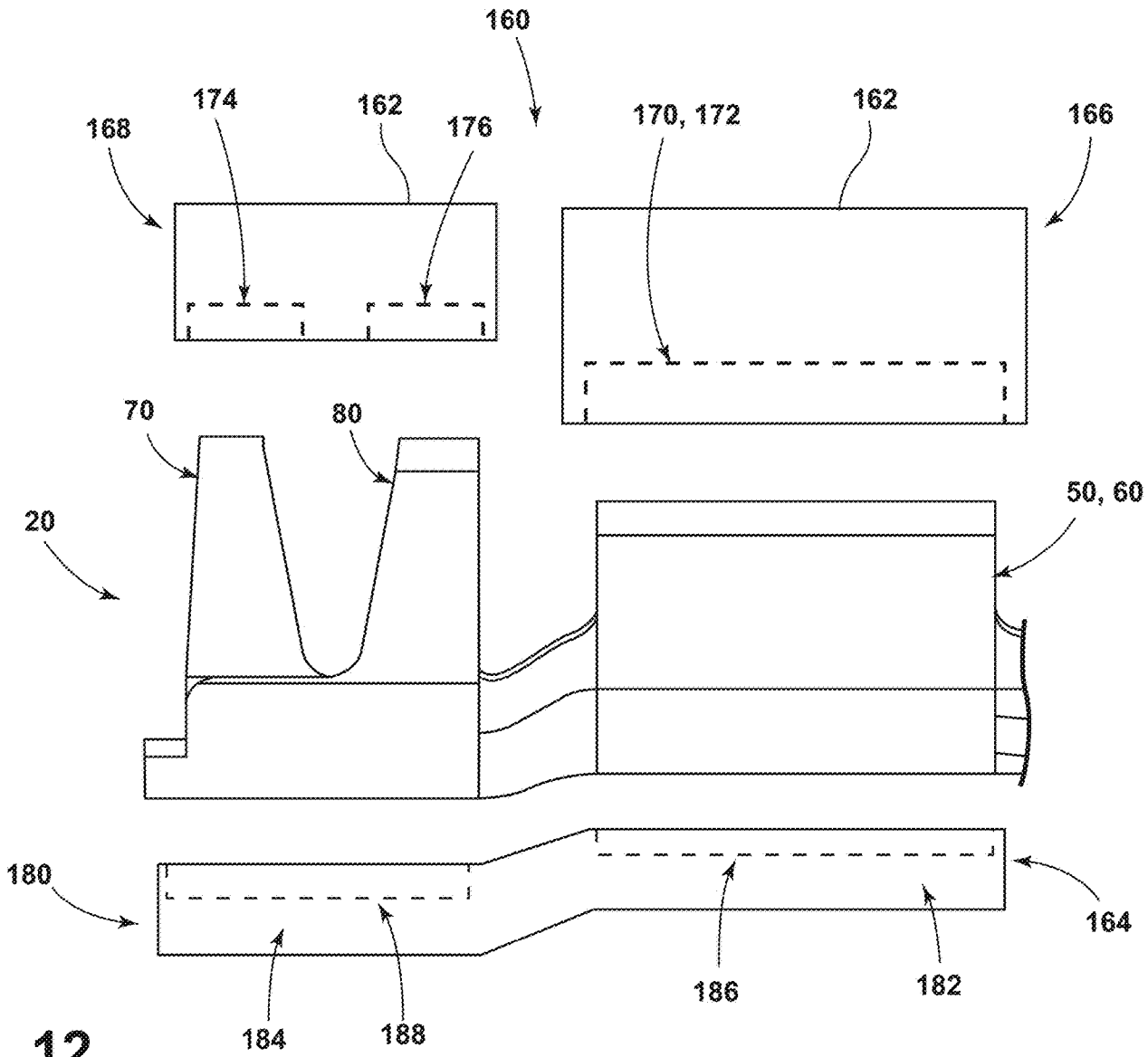
FIG. 12 is a side view generally illustrating an embodiment of a terminal assembly and die according to teachings of the present disclosure.

With embodiments, such as generally illustrated in FIGS. 11A, 11B, and 12, the top portion 162 may be disposed proximate the wings 50, 60, 70, 80 of the terminal 20. The bottom portion 164 may be disposed proximate the body portion 40 of the terminal 20, the first body portion 140 of the terminal insert 120, and/or the second body portion 142 of the terminal insert 120. In embodiments, the top portion 162 of the die 160 may include a conductor crimping portion 166 and/or an insulator crimping portion 168. As generally illustrated in FIG. 12, the conductor crimping portion 166 may be independent from the insulator crimping portion 168 (e.g., the conductor crimping portion 166 and the insulator crimping portion 168 may be separate pieces that may be independently movable). In embodiments, the conductor crimping portion 166 may be configured to crimp the first wing 50 and the second wing 60 of the terminal 20 and/or the first wing 144 and the second wing 146 of the terminal insert 120, such as onto the conductor 26 of the wire 24. The insulator crimping portion 168 may be configured to crimp the third wing 70 and the fourth wing 80 of the terminal 20 and/or the third wing 150 and the fourth wing 152 of the terminal insert 120, such as onto the insulator 28 of the wire 24.

With embodiments, such as generally illustrated in FIGS. 11A-12, a die top portion 162 may include a first recess 170 and/or a second recess 172. The first recess 170 may receive at least a portion of the first terminal wing 50 and/or the first terminal insert wing 144. The second recess 172 may receive at least a portion of the second terminal wing 60 and/or the second terminal insert wing 146. The first recess 170 and/or the second recess 172 may include one or more of a variety of shapes, sizes, and/or configurations. For example and without limitation, the first recess 170 and/or the second recess 172 may be substantially oval-shaped and/or generally rounded. The first recess 170 and/or the second recess 172 may be configured to bend (e.g., crimp) the first wing 50 and the second wing 60 of the terminal 20 and/or the first wing 144 and the second wing 146 of the terminal insert 120 onto the wire 24.

In embodiments, the die top portion 162 may include a third recess 174 and/or a fourth recess 176 that may be generally aligned with the X-direction and/or may be offset relative to each other in the X-direction and/or the Y-direction (see, e.g., FIG. 12). The third recess 174 and the fourth recess 176 may be configured to bend (e.g., crimp) the third wing 70 and the fourth wing 80 of the terminal 20 and/or the first wing 144 and the second wing 146 of the terminal insert 120 onto the wire 24. The first recess 170 may contact the first wing 50, the second recess 172 may contact the second wing 60, the third recess 174 may contact the third wing 70, and/or the fourth recess 176 may contact the fourth wing 80 (e.g., simultaneously). The recesses 170, 172, 174, 176 may or may not be substantially similar or the same shape and/or size.

In embodiments, the die may include a bottom portion 180. The bottom portion 180 may include one or more of a variety of shapes, sizes, and/or configurations. For example and without limitation, the bottom portion 180 may be substantially U-shaped, V-shaped, oval-shaped, and/or rounded. In embodiments, the bottom portion 180 may retain the terminal 20 during bending. For example and without limitation, the bottom portion 180 may retain the terminal body portion 40 (e.g., the bottom portion 180 may limit movement of the terminal body portion 40 in at least one direction). The bottom portion 180 may include an insulator portion 182 and/or a conductor portion 184. The insulator portion 182 may be wider than the conductor portion 184. The insulator portion 182 may be configured to retain (e.g., restrict movement in at least one direction) the terminal body portion 40 at or about the third wing 70 and/or the fourth wing 80. The conductor portion 184 may be configured to retain the terminal body portion 40 at or about the first wing 50 and/or the second wing 60. The conductor portion 184 may include a first recess 186 that may restrict movement of the terminal 20 in at least one direction. The insulator portion 182 may include a second recess 188 that may restrict movement of the terminal 20 in at least one direction.

With embodiments, during crimping, the top portion 162 of the die 160 may be moved, in a Z-direction (e.g., downward toward the terminal 20) into contact with the terminal 20, such as while the bottom portion 164 of the die 160 supports the terminal 20 from the opposite direction (or vice versa), to form a crimped terminal assembly 22. The first recess 170 may contact the first wing 50, and/or the second recess 172 may contact the second wing 60 to crimp the terminal assembly 22. The third recess 174 may contact the third wing 70, and/or the fourth recess 176 may contact the fourth wing 80 to crimp the terminal assembly 22. Crimping the wings 50, 60, 70, 80 may include bending the wings 50, 60, 70, 80 such that the wings 50, 60, 70, 80 fold inward, such as about 180 degrees, for example. Crimping the terminal assembly 22 may include bending the wings 50, 60, 70, 80 such that the respective wings 144, 146, 150, 152 of the terminal insert 120 bend. As the die 160 bends the terminal wings 50, 60, 70, 80, the wings 50, 60, 70, 80 may contact the terminal insert wings 144, 146, 150, 152 and/or may bend the terminal insert wings 144, 146, 150, 152. The wings 144, 146, 150, 152 of the terminal insert 120 may bend inward towards the first body portion 140 and the second body portion 142. The first wing 50 of the terminal 20 may contact the first wing 144 of the terminal insert 120 and/or may bend the first wing 144 towards the first body portion 140 such that the first wing 144 crimps onto a portion of the conductor 26. The second wing 60 of the terminal 20 may contact the second wing 146 of the terminal insert 120 and/or may bend the first wing 144 towards the first body portion 140 such that the second wing 146 crimps onto a portion of the conductor 26. The third wing 70 of the terminal 20 may contact the third wing 150 of the terminal insert 120 and/or may bend the third wing 150 towards the second body portion 142 such that the third wing 150 crimps around the insulator 28. The fourth wing 80 of the terminal 20 may contact the fourth wing 152 of the terminal insert 120 and/or may bend the fourth wing 152 towards the second body portion 142 such that the fourth wing 152 crimps around the insulator 28. The first wings 50, 144 and second wings 60, 146 of the terminal 20 and/or the terminal insert 120 may be in contact with the conductor 26. The third wings 70, 150 and the fourth wings 80, 152 of the terminal 20 and/or the terminal insert 120 may be in contact with the conductor 26 and/or insulator 28.

Figure 16:
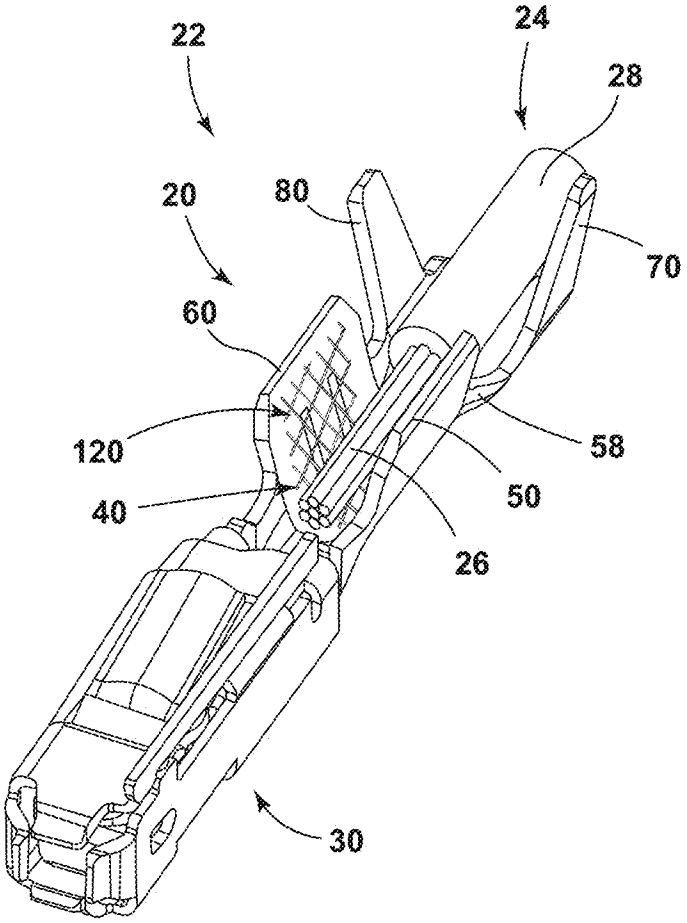
FIG. 16 is a perspective view generally illustrating an embodiment of a terminal assembly according to teachings of the present disclosure.
Figure 15:
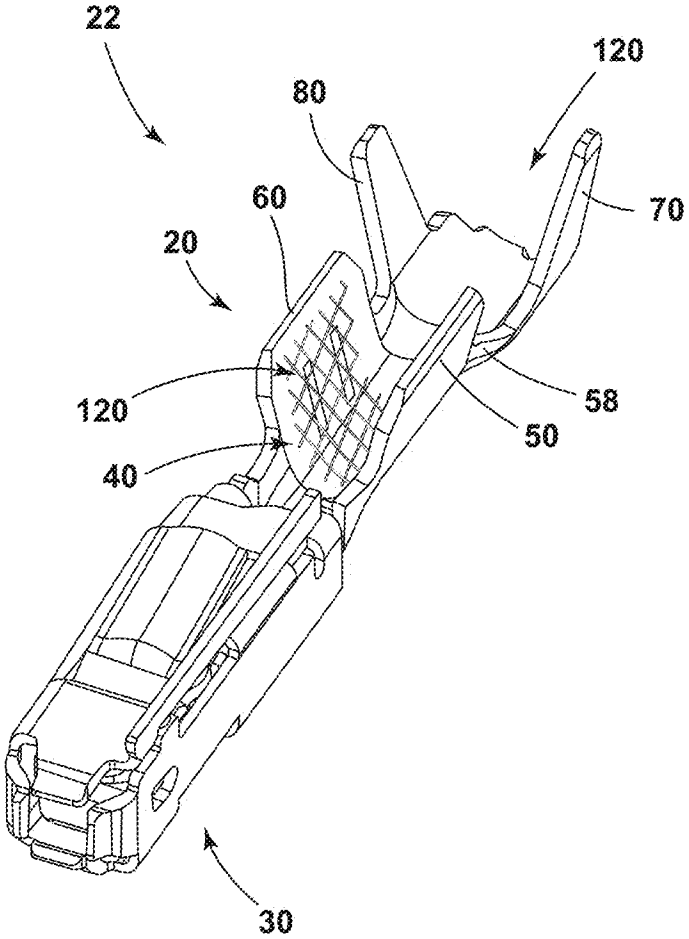
FIG. 15 is a perspective view generally illustrating an embodiment of a terminal assembly according to teachings of the present disclosure.

In embodiments, such as generally illustrated in FIGS. 15 and 16, a terminal insert 120 may be configured to be inserted into the terminal 20 at or about the first wing 50 and/or the second wing 60 (e.g., at least partially in the first body portion 40) and may not extend into the connection portion 58 or the second body portion 142. For example and without limitation, the terminal insert may include a generally rectangular configuration and/or may not include a third wing 70 or a fourth wing 80. The terminal insert 120 may contact the conductor 26 and/or may not contact the insulator 28. A terminal insert 120 may be shorter (e.g., in the X-direction) than the terminal 20. Before crimping, the terminal insert 120 may be substantially U-shaped or may be substantially planar. The terminal insert 120 may be substantially planar prior to crimping, and/or the die 160 may be configured to bend the planar terminal insert 120 into a U-shape during crimping.

Figure 18:
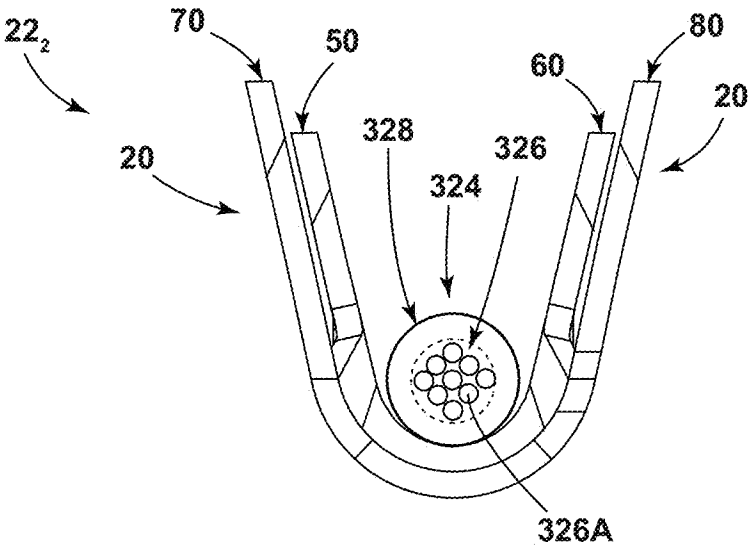
FIG. 18 is a cross-sectional view generally illustrating an embodiment of a terminal assembly according to teachings of the present disclosure.
Figure 17:
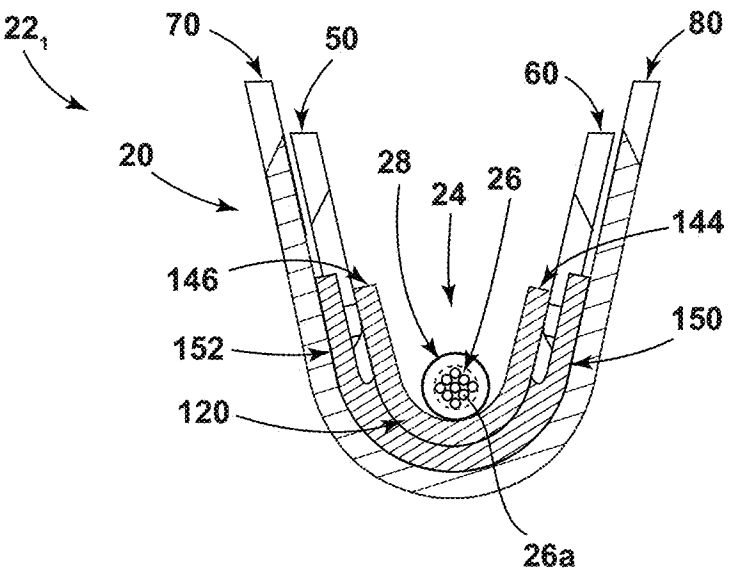
FIG. 17 is a cross-sectional view generally illustrating an embodiment of a terminal assembly according to teachings of the present disclosure.

With embodiments, such as generally illustrated in FIGS. 17 and 18, terminals 20 may be utilized in connection with wires of different configurations (e.g., sizes, diameters, gauges, etc.). A first terminal assembly $\mathbf{22}_1$ may include a terminal 20, a terminal insert 120, and a wire 24, and a second terminal assembly $\mathbf{22}_2$ may include another terminal 20 and a second wire 324. The wires 24, 324 may include conductors 26, 326 and/or insulators 28, 328. A diameter of the first wire 24 may be smaller than a diameter of the second wire 324. For example and without limitation, the diameter of the first wire 24 may be at least about 20%, at least about 30%, at least about 40%, and/or at least about 50% smaller than the diameter of the second wire 324.

In embodiments, the terminal insert 120 may be used in connection with the first terminal assembly $\mathbf{22}_1$ to compensate for a smaller wire 24. The terminal insert 120 may facilitate a sufficient final crimp, such as by filling in the excess area/volume when the relatively small wire 24 (e.g., smaller than the second wire 324) is used. A first extraction force associated with the first terminal assembly $\mathbf{22}_1$ may be substantially the same as a second extraction force associated with the second terminal assembly $\mathbf{22}_2$.

In embodiments, a terminal insert 120 may increase an effective diameter of a wire (e.g., the first wire 24) such that the effective diameter of the first wire 24 is substantially equal to the diameter of the second wire 324.

If a smaller wire 24 is used without a terminal insert 120, the final crimped terminal assembly may include gaps and/or spaces 130 between the conductor portions 26A, which may result in an insufficient final crimp (e.g., the electrical and/or physical connection between the conductor 26 and the terminal 20 may not be sufficiently reliable).

With embodiments, a terminal insert 120 may be formed (e.g., cut, stamped, etc.) from a continuous ribbon of material that may be inserted into the terminal 20 and/or terminal assembly 22. Prior to or during crimping, the terminal insert 120 may be separated from the material feed. Forming the terminal insert 120 and crimping the terminal assembly 22 may be accomplished in a single step or multiple steps.

Figure 19:
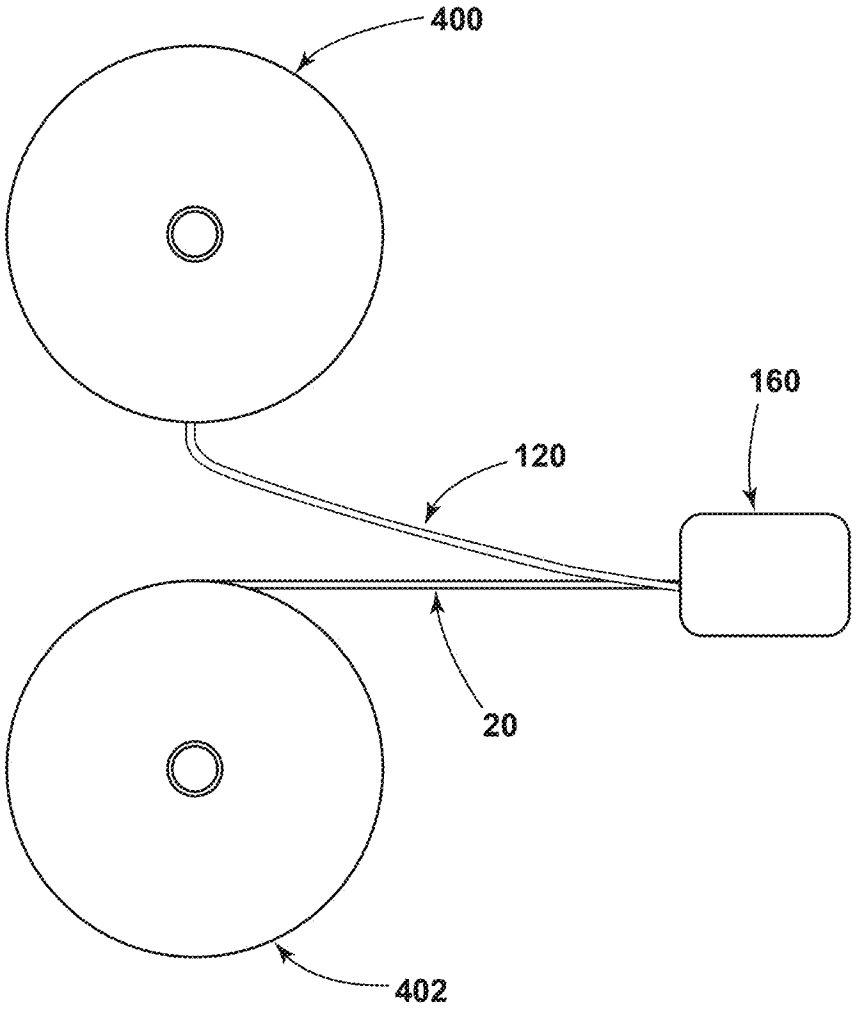
FIG. 19 is a side view generally illustrating an embodiment of a terminal assembly according to teachings of the present disclosure.

With embodiments, such as generally illustrated in FIGS. 5 and 19, a plurality of terminal inserts 120 may be connected to a terminal insert reel 400. A plurality of terminals 20 may be connected to a terminal reel 402. The terminal reel 402 may include a plurality of terminals 20 wound about a center of the terminal reel 402, and/or the terminal insert reel 400 may include a plurality of terminal inserts 120 wound about a center of the terminal insert reel 402. The terminal insert reel 402 may be disposed vertically above the terminal reel 400 such that the terminal inserts 120 may be fed into respective terminals 20 (e.g., from the X-direction and/or the Z-direction) during assembly. The terminal insert 120 may be connected to the plurality of terminal inserts 120 of the terminal insert reel 400 via a connecting segment 122 (see, e.g., FIG. 5). During crimping, or prior to crimping, a die (e.g., the die 160) may separate the terminal inserts 120 from the terminal insert reel 400 and/or separate the terminals 20 from the terminal reel 402. Respective terminals 20 and terminal inserts 120 may be fed into a die 160 from the reels 402, 400 at substantially the same time, which may expedite assembly.

In embodiments, the terminal assembly 22 may include a terminal 20, a terminal insert 120, and/or a wire 24. After the terminal assembly 22 is crimped and/or bent onto the wire 24, the terminal insert 120 may not have a uniform cross section throughout the crimped terminal assembly 22 (e.g., the apertures 192 in the terminal insert 120 may result in a non-uniform crimp). During crimping, the die 160 may move the terminal insert 120 in the X-direction which may result in portions of the terminal assembly 22 including a nonuniform electrical connection between the terminal 20, the terminal insert 120, and the conductor 26. In embodiments, after crimping, at least a portion of a terminal insert 120 may be disposed at or about a top surface of the conductor 26 and/or above a middle of the conductor 26.

With embodiments, after crimping, the crimped terminal assembly 22 may include an extraction force (e.g., between the terminal 20, the terminal insert 120, and the wire 24) of about 40 newtons, for example. After crimping, a terminal assembly 22 may, for example and without limitation, include a height in the Z-direction of about 0.81 mm to about 0.87 mm, and/or a width in the Y-direction of about 1.25 mm to about 1.45 mm.

In contrast with embodiments of terminals assemblies 22, using terminals of several different configurations/sizes may complicate assembly, require additional handling processes, and/or involve greater costs, among other issues.

Embodiments of a terminal assembly 22 may be used for mechanical connections and are not limited to electrical wires or applications.

Various embodiments are described herein for various apparatuses, systems, and/or methods. Numerous specific details are set forth to provide a thorough understanding of the overall structure, function, manufacture, and use of the embodiments as described in the specification and illustrated in the accompanying drawings. It will be understood by those skilled in the art, however, that the embodiments may be practiced without such specific details. In other instances, well-known operations, components, and elements have not been described in detail so as not to obscure the embodiments described in the specification. Those of ordinary skill in the art will understand that the embodiments described and illustrated herein are non-limiting examples, and thus it can be appreciated that the specific structural and functional details disclosed herein may be representative and do not necessarily limit the scope of the embodiments.

Reference throughout the specification to "various embodiments," "with embodiments," "in embodiments," or "an embodiment," or the like, means that a particular feature, structure, or characteristic described in connection with the embodiment is included in at least one embodiment. Thus, appearances of the phrases "in various embodiments," "with embodiments," "in embodiments," or "an embodiment," or the like, in places throughout the specification are not necessarily all referring to the same embodiment. Furthermore, the particular features, structures, or characteristics may be combined in any suitable manner in one or more embodiments. Thus, the particular features, structures, or characteristics illustrated or described in connection with one embodiment/example may be combined, in whole or in part, with the features, structures, functions, and/or characteristics of one or more other embodiments/examples without limitation given that such combination is not illogical or non-functional. Moreover, many modifications may be made to adapt a particular situation or material to the teachings of the present disclosure without departing from the scope thereof.

It should be understood that references to a single element are not necessarily so limited and may include one or more of such element. Any directional references (e.g., plus, minus, upper, lower, upward, downward, left, right, leftward, rightward, top, bottom, above, below, vertical, horizontal, clockwise, and counterclockwise) are only used for identification purposes to aid the reader's understanding of the present disclosure, and do not create limitations, particularly as to the position, orientation, or use of embodiments.

Joinder references (e.g., attached, coupled, connected, and the like) are to be construed broadly and may include intermediate members between a connection of elements and relative movement between elements. As such, joinder references do not necessarily imply that two elements are directly connected/coupled and in fixed relation to each other. The use of "e.g." in the specification is to be construed broadly and is used to provide non-limiting examples of embodiments of the disclosure, and the disclosure is not limited to such examples. Uses of "and" and "or" are to be construed broadly (e.g., to be treated as "and/or"). For example and without limitation, uses of "and" do not necessarily require all elements or features listed, and uses of "or" are intended to be inclusive unless such a construction would be illogical.

While processes, systems, and methods may be described herein in connection with one or more steps in a particular sequence, it should be understood that such methods may be practiced with the steps in a different order, with certain steps performed simultaneously, with additional steps, and/or with certain described steps omitted.

It is intended that all matter contained in the above description or shown in the accompanying drawings shall be interpreted as illustrative only and not limiting. Changes in detail or structure may be made without departing from the present disclosure.

What is claimed is:

1. A terminal assembly comprising:
a terminal; and
a terminal insert;
wherein the terminal insert is configured to be disposed at least partially in the terminal;
the terminal and the terminal insert are configured to receive at least a portion of a wire;
the terminal and the terminal insert are configured to be crimped to the said wire; and
the terminal insert includes a monolithic component formed independently of the terminal.

2. The terminal assembly of claim 1, wherein the terminal insert includes a plurality of crossing metal segments.

3. The terminal assembly of claim 1, wherein the terminal insert includes a first insert wing, a second insert wing, a third insert wing, and a fourth insert wing.

4. The terminal assembly of claim 3, wherein the terminal includes a first wing, a second wing, a third wing, and a fourth wing.

5. The terminal assembly of claim 4, wherein the first wing of the terminal is disposed proximate the first wing of the terminal insert; the second wing of the terminal is disposed proximate the second wing of the terminal insert; the third wing of the terminal is disposed proximate the third wing of the terminal insert; and the fourth wing of the terminal is disposed proximate the fourth wing of the terminal insert.

6. The terminal assembly of claim 3, wherein the terminal insert includes a first channel provided by the first insert wing and the second insert wing; the terminal insert includes a second channel provided by the third insert wing and the fourth insert wing; and
the second channel is wider than the first channel.

7. The terminal assembly of claim 6, wherein said wire includes a conductor portion and an insulator portion; the first channel is configured to receive at least a portion of the conductor portion; and the second channel is configured to receive at least a portion of the insulator portion.

8. A method of assembling a terminal assembly, the method comprising:
providing a terminal, the terminal including:
a terminal body;
a first wing, a second wing, a third wing, and a fourth wing;
providing a terminal insert, the terminal insert including a first insert wing and a second insert wing;
providing a wire;
inserting the terminal insert into the terminal;
inserting the wire into the terminal insert and the terminal; and
crimping the terminal insert and the terminal to the wire.

9. The method of claim 8, wherein the terminal insert includes a monolithic component formed independently of the terminal.

10. The method of claim 8, wherein providing the terminal includes providing the terminal from a terminal reel; and providing the terminal insert includes providing the terminal insert from a terminal insert reel.

11. The method of claim 8, wherein crimping the terminal insert and the terminal to the wire includes deforming the terminal insert to fill gaps between the terminal and a conductor of the wire.

12. The method of claim 8, wherein inserting the terminal insert into the terminal includes disposing the first insert wing, the second insert wing, a third insert wing, and a fourth insert wing of the terminal insert in contact with the first wing, the second wing, a third wing, and a fourth wing of the terminal, respectively.

13. The method of claim 8, wherein after crimping, at least a portion of the terminal insert is disposed at a top surface of a conductor of the wire.

14. The method of claim 8, wherein the terminal insert (i) is configured to increase an effective diameter of the wire; (ii) is formed separately from the terminal; and (iii) includes a third insert wing.

15. An electrical assembly comprising:

a first terminal assembly, including:

a first terminal;

a terminal insert; and a first wire; and a second terminal assembly, including:

a second terminal; and a second wire;

wherein the first terminal is substantially the same as the second terminal; the first wire is smaller than the second wire; the first terminal is crimped to the terminal insert and the first wire; and the second terminal is crimped to the second wire; and wherein the terminal insert increases an effective diameter of the first wire such that the effective diameter of the first wire is substantially equal to a diameter of the second wire.

16. The electrical assembly of claim 15, wherein first and second insert wings of the terminal insert provide a first channel; third and fourth wings of the terminal insert provide a second channel; and the second channel is wider in a lateral direction of the terminal insert than the first channel.

17. The electrical assembly of claim 15, wherein the terminal insert is substantially U-shaped and includes a plurality of crossing metal segments.

18. The electrical assembly of claim 15, wherein the first terminal assembly and the second terminal assembly are configured such that a first extraction force associated with the first terminal assembly is substantially the same as a second extraction force associated with the second terminal assembly.

19. The electrical assembly of claim 15, wherein the terminal insert includes (i) a first body portion including first and second insert wings, (ii) a second body portion including third and fourth insert wings, and (iii) a connecting portion extending between the first body portion and the second body portion; and a height of the connecting portion is shorter than heights of the first insert wing, the second insert wing, the third insert wing, and the fourth insert wing.

20. The electrical assembly of claim 15, wherein the terminal insert includes a monolithic component formed independently of the first terminal; and the terminal insert includes a first insert wing, a second insert wing, and a third insert wing.

* * * * *